US009200877B1

(12) United States Patent
Rubin

(10) Patent No.: US 9,200,877 B1
(45) Date of Patent: Dec. 1, 2015

(54) BIOLOGICAL ACTIVE BULLETS, SYSTEMS, AND METHODS

(76) Inventor: Darren Rubin, Wesley Chapel, FL (US)

( * ) Notice: Subject to any disclaimer, the term of this patent is extended or adjusted under 35 U.S.C. 154(b) by 155 days.

(21) Appl. No.: 13/461,863

(22) Filed: May 2, 2012

(51) Int. Cl.
*F42B 12/36* (2006.01)
*F42B 12/46* (2006.01)
*F42B 12/54* (2006.01)

(52) U.S. Cl.
CPC ..... *F42B 12/36* (2013.01)

(58) Field of Classification Search
CPC ..... F42B 12/00; F42B 12/02; F42B 12/36; F42B 12/46; F42B 12/54
USPC ..... 102/512
See application file for complete search history.

(56) References Cited

U.S. PATENT DOCUMENTS

| | | | | | |
|---|---|---|---|---|---|
| 693,329 | A * | 2/1902 | Neubauer | 102/512 |
| 3,308,818 | A * | 3/1967 | Rutkowski | 604/69 |
| 3,502,025 | A * | 3/1970 | Payne | 102/512 |
| 3,584,582 | A * | 6/1971 | Muller | 102/512 |
| 3,616,758 | A * | 11/1971 | Komarov | 102/512 |
| 3,754,509 | A * | 8/1973 | Gogen | 102/512 |
| 3,763,786 | A * | 10/1973 | MacDonald | 102/512 |
| 3,820,465 | A * | 6/1974 | Delphia | 102/512 |
| 3,901,158 | A * | 8/1975 | Ferb | 102/512 |
| 3,948,263 | A * | 4/1976 | Drake et al. | 424/422 |
| 3,982,536 | A * | 9/1976 | Krogseng et al. | 424/422 |
| 4,136,616 | A * | 1/1979 | Schirneker | 102/510 |
| 4,597,580 | A * | 7/1986 | Gassie | 473/577 |
| 4,976,202 | A * | 12/1990 | Honigsbaum | 102/367 |
| 5,515,785 | A * | 5/1996 | Zglenicki | 102/473 |
| 5,821,450 | A * | 10/1998 | Fedida | 102/370 |
| 6,375,971 | B1 * | 4/2002 | Hansen | 424/422 |
| 7,013,810 | B1 * | 3/2006 | Brydges-Price | 102/502 |
| 8,056,480 | B2 * | 11/2011 | Brydges-Price | 102/502 |
| 2003/0029348 | A1 * | 2/2003 | Bailey | 102/512 |
| 2003/0159612 | A1 * | 8/2003 | Ziemack | 102/512 |
| 2003/0167955 | A1 * | 9/2003 | Baltos | 102/512 |
| 2005/0016412 | A1 * | 1/2005 | Vasel et al. | 102/502 |
| 2006/0011090 | A1 * | 1/2006 | Vasel et al. | 102/512 |
| 2006/0278116 | A1 * | 12/2006 | Hunt | 102/512 |
| 2011/0214584 | A1 * | 9/2011 | Purvis | 102/502 |

* cited by examiner

*Primary Examiner* — Bret Hayes

(57) ABSTRACT

A novel biological active bullet able to be discharged from a firearm, the ammunition essentially comprising a bullet in a cartridge, the bullet associated with/containing at least one biological active substance, along with a method of use of delivering with this bullet at least one biological active substance having at least one biological effect in the target upon impact and penetration, in addition to the bullet wound, and thus, having additional functions and applications than prior art bullets.

2 Claims, 6 Drawing Sheets

Fig. 3A
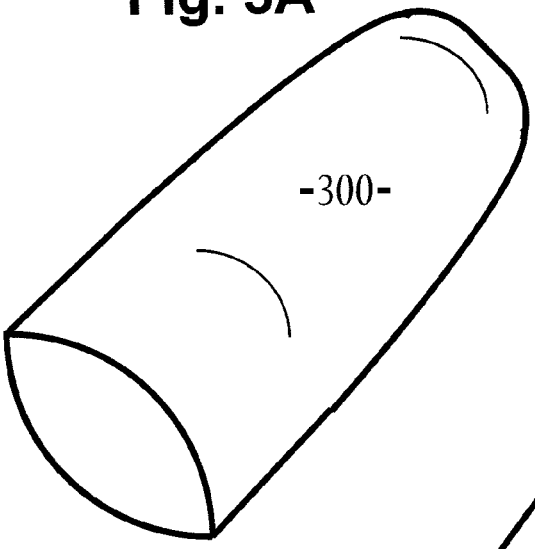
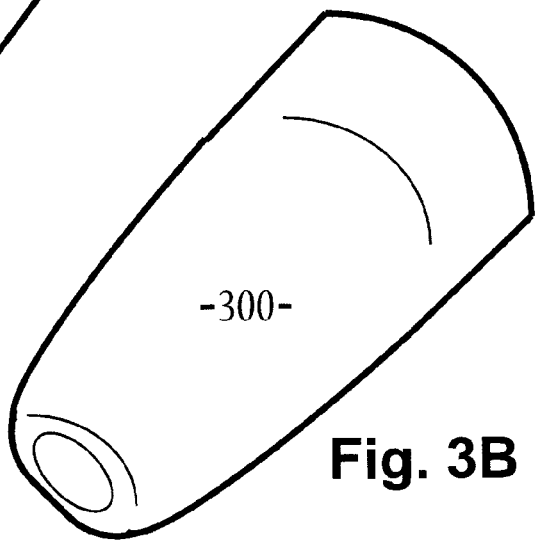
Fig. 3B
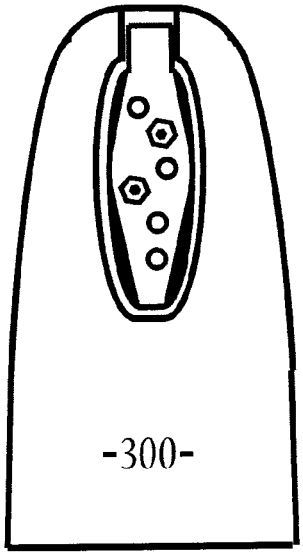
Fig. 3C

BIOLOGICAL ACTIVE BULLETS, SYSTEMS, AND METHODS

BACKGROUND OF THE INVENTION

1. Field of the Invention

The present invention relates to a novel biological active bullet and more particularly pertains to a method for delivering at least one biological active substance to the body of a target upon bullet impact and penetration. The term "biological active substance" refers to any material that is biological, pharmaceutical, chemical, or radioactive that has at least some biological effect on or within the body of a target. This biological effect may include, but is not limited to, the interaction of this active substance with at least one of: organ systems, tissues, bodily fluids, cells, intracellular structures, and biochemicals. For instance, the desired biological effect of this biological bullet may include convulsions and disorientation that incapacitates a dangerous target. Or, the active substance delivered by this bullet may include stopping the heart or respiration of the target from an otherwise, non-fatal bullet wound. Biological active bullets can have the potential to make every shot fatal, and thus, have the ability to conserve ammunition. The result of biological effects serve additional functions not seen in other bullets, and therefore, the present invention also includes numerous other uses and improvements, with the ability to enhance modern warfare. Furthermore, the present invention allows the delivery of biological active substances to a target from a safe distance. This may prove useful in treating or neutralizing a disoriented or rabid individual carrying an infectious agent with epidemic potential. The present invention also affords the ability to deliver a wide range of active substances and combinations of active substances, and the ability to activate a substance upon impact and penetration.

2. Description of the Prior Art

Bullets are projectiles discharged from a firearm, such as a hand gun or rifle. Bullets have the primary function of piercing a living target, such as a human enemy, such as for military combat or self-defense.

Bullets have evolved many times over several centuries, resulting in many improvements, such as modern-day, metal jacketed bullet cartridges, invented by Swiss Major Eduard Rubin in the late 1800s, as described in U.S. Pat. No. 468,580.

Other advances in bullet technology include the invention of various hollow point bullets, such as those described in U.S. Pat. Nos. 5,131,123; 5,259,320; and 7,171,905. Such bullets have a pit or hollowed out shape in its tip, often associated with radially directed ribs or creases which weaken the structure. Upon impact, these stress lines allow the bullet to expand radially when entering a target in a rose petal shape. Such bullets become wider to disrupt more tissue, and create maximum hydraulic shock, causing the target to absorb more energy, while minimizing over-penetration and collateral damage. In other words, hollow point bullets are designed to not exit a target. Hollow point bullets vary in the size and shape of the hollow cavity.

U.S. Pat. No. 7,380,502 describes a bullet with a forward end cavity and a nose element of resilient/elastomeric material that is received into this frontal cavity. The purpose of this softer pointed tip is to prevent the accidental triggering of the primer of another cartridge in front of this cartridge, when stored in a tubular magazine, such as in a rifle; while maintaining aerodynamic efficiency. The soft point nose/tip is held firmly in place by the jacket.

U.S. Pat. Nos. 7,748,325 and 7,874,253 describe a bullet with the ability to carry a supplemental payload, without any claim to what that supplemental payload is. Furthermore, U.S. Pat. Nos. 7,748,325 and 7,874,253 describe a bullet with three sections; a nose portion, a tail portion, and an intermediate interface portion. This intermediate interface portion connects the nose and tail portions, and is designed to rupture and separate the nose and tail portions upon impact. The present invention differs from this respect in that it does not have a nose and a tail portion held together by an intermediate interface portion, whereby that intermediate interface portion ruptures upon impact.

The present invention of a biologic active bullet also has numerous advantages over hypodermic projectiles, such as that described by U.S. Pat. No. 3,901,158. Hypodermic projectiles, such U.S. Pat. No. 3,901,158 and hypodermic darts, are limited to the delivery of a liquid drug, generally with the assistance of pressurized gas. The present invention transcends such limitations because its biological active need not be an injectable liquid. For instance, the present invention can deliver biological active substances in the form of lyophilized powders, hardened gels, and film coatings. Hypodermic projectiles are generally used for veterinary purposes, whereas, the present invention serves as weapon ammunition that wounds a target while concurrently delivering the active agent.

U.S. Pat. No. 6,223,658 describes a paint ball projectile that can disperse a liquid pharmaceutical agent on the exterior surface of a target upon impact, in a non-lethal manner. The present invention can deliver one or more pharmaceutical agents into the interior of a target, and as such, affords greater advantages and applications.

WIPO Patent Application WO/2000/002004 describes a firearm projectile configured for limited penetration into a target, preferably designed for use with shotguns, e.g. a shotgun cartridge, comprising a plurality of subprojectiles and a friable capsule having: a nose for providing a first point of impact with said target; a cavity for retaining the subprojectiles during travel from the firearm to the target; and a trailing end having a density lower than the combined density of said internal chamber and said subprojectiles. Said subprojectiles may be coated with toxins, or comprising of toxins and medicines. The present invention does not consist of or utilize numerous subprojectiles (shotgun pellets), and is therefore capable of various cartridge and firearm formats, and can allow for bullet projectiles of greater penetration into a target and a greater firing range.

Therefore, it can be appreciated that there exists a continuing need for new and improved biological active bullets, systems, and methods which can be used for delivering at least one biological active substance to the body of a target upon bullet impact and penetration. In this regard, the present invention substantially fulfills this need.

SUMMARY OF THE INVENTION

In view of the foregoing disadvantages inherent in the known types of bullet cartridges and projectiles of known designs and configurations now present in the prior art, the present invention provides an improved biological active bullet system. As such, the general purpose of the present invention, which will be described subsequently in greater detail, is to provide a new and improved biological active bullet system and method which has all the advantages of the prior art and none of the disadvantages.

To attain this, the present invention essentially comprises a bullet in a cartridge, the bullet associated with or containing at least one biological active substance, the bullet capable of being fired as a projectile from a firearm, and delivering at least one biological active substance having at least one biological effect in the target upon impact and penetration, in addition to the bullet wound, and thus, having additional functions and applications than prior art bullets.

The at least one biological active substance may exist in an active state or a potentially active state. Substances that exist in a potentially active state require activation. Activation may be achieved by various ways, such as from interaction with the target itself, including bodily tissues and fluids, bodily enzymes, and extracellular, cellular, or mitochondrial proteins and cofactors; and/or the conditions therein, such as the temperature and pH found in the body. For example, the potentially active substance may require processing by bodily protease enzymes for activation, or require mineral cofactors found in the target's blood. In other examples, activation may take place from the interaction of the substance with an excipient, other active, or other substance, also associated with the bullet. For instance, the potentially active substance may be a catalyst requiring a cofactor for significant activation. This cofactor may also be associated with the bullet, but unable to interact with the catalyst until the two substances are mixed together during impact and penetration of the bullet.

As with most cartridges, the cartridge of the present invention includes a bullet, a case/shell, a propellant, such as gunpowder or cordite, a primer which ignites the propellant once the firearm is triggered, along with an annular groove and flange of the casing, at the back-end of the bullet, that aids in loading the cartridge. The bullet may also contain a jacket. Next provided is at least one cavity, preferably near the tip of the bullet. This cavity contains at least one biological active substance. As such, the surface of this cavity may be coated with this biological active substance, or some volume of this cavity may be filled with this biological active substance. In a primary embodiment, the active substance is contained and retained in this bullet cavity by a cap/plug. This cap/plug may itself be coated with the biological active substance, or may be embedded with this biological active substance. In some embodiments, the active substance helps form a solid of a desired shape that is adapted to fit the shape of the cavity, to help retain the active substance in a fixed position, so as to help prevent interference with the bullet's trajectory. Yet in other embodiments, the cap/plug can be secured by the jacket of the bullet, or the cap/plug may have securing means, such as threads designed adapted to fit complementary securing means, such as threads, in the bullet cavity. The cap/plug may also be frangible or at least partially dissolvable upon impact and penetration.

In some embodiments of the invention, the cavity of the tip of the bullet serves as a hollow point cavity, such that the bullet expands upon entering a target in order to decrease penetration and disrupt more tissue, and dissipate more energy, as it travels through the target, while reducing the risk of collateral damage. Such a hollow point cavity feature makes it very likely that the bullet will remain in the target to deliver biological active substances effectively, instead of exiting the target and risking injury to an unintentional target.

The present invention is able to deliver a wide variety of biological active substances and combinations of biological active substances. This includes, but is not limited to: catalysts, enzymes, or inhibitors, such as to cause or inhibit biochemical reactions in the target; vasodilators and anticoagulants, such as to cause enhanced wound bleeding in the target; radioactive substances, such as to cause cellular and DNA damage, or to detect a wounded target trying to pass through airport security instruments, or to track a wounded target, such as by detecting radiation in dripping blood; nerve agents and neurotoxins, such as to damage, incapacitate, or kill a target from a non-fatal bullet wound; blistering agents, nettle agents, urticants, and corrosives, to cause tissue damage and to incapacitate the target with excessive pain; other pain-inducing agents; muscle relaxants, paralytics, and sedatives to slow or stop a target, such as when not trying to kill the target; spasmodic agents and convulsives to incapacitate and potentially kill the target; hallucinogenic agents to disorient a target; infectious agents, such as to inoculate a target so as to infect that target; as well as, delivering curative agents to a target at a distance when it would be otherwise unsafe to administer the curative agent in close contact, such as when the target is hostile.

The bullet of the present invention is capable of being associated with biological active substances in a variety of formats, such as solids, liquids, gels, pastes, films, fast-dissolving formats, slow-release formats, along with a variety of excipients that may aid the delivery of the substance(s). Also, the bullet of the present invention is capable of delivering a wide range of biological active substance quantity, such as up to and over one gram of material. Some biological active substances are lethal in small quantities. For example, the toxic protein ricin is lethal at under 2 mg when administered to a target's body. Such a quantity of ricin can occupy a volume of space less than 0.5% the size of an average aspirin tablet, and thus have minimal effect on the bullet's ballistics.

The present invention also includes methods associated with adding the biological active substance to the bullet, such as during manufacture, or out in the field. The present invention also includes methods of using the biological active bullet cartridge, including loading and discharging the cartridge to affect the target with the unique features of this novel invention.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It therefore an object of the present invention to provide a new and improved biological active bullet which has all of the advantages of prior art bullets of known designs and configurations and none of the disadvantages.

It is another object of the present invention to provide a new and improved biological active bullet and cartridge which may be easily and efficiently manufactured and marketed.

It is further object of the present invention to provide a new and improved biological active bullet system which is of durable and reliable constructions.

An even further object of the present invention is to provide a new and improved biological active bullet system which is susceptible of a low cost of manufacture with regard to both materials and labor, and which accordingly is then susceptible of low prices of sale, thereby making such biological active bullet system economical. Because the biological active bullet has the ability to kill a target that would otherwise survive a non-fatal gunshot wound, this invention also has potential to conserve ammunition.

Even still another object of the present invention is to provide a biological active bullet system for delivering at least one biological active substance to the body of a target upon bullet impact and penetration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3A shows a bottom-up side view of the primary embodiment biological active bullet after leaving its cartridge.

FIG. 3B likewise shows this biological active bullet from a top-down side perspective.

FIG. 3C shows the longitudinal cross-section of this biological active bullet separate from its cartridge.

DESCRIPTION OF THE PREFERRED EMBODIMENT

Figure 1:
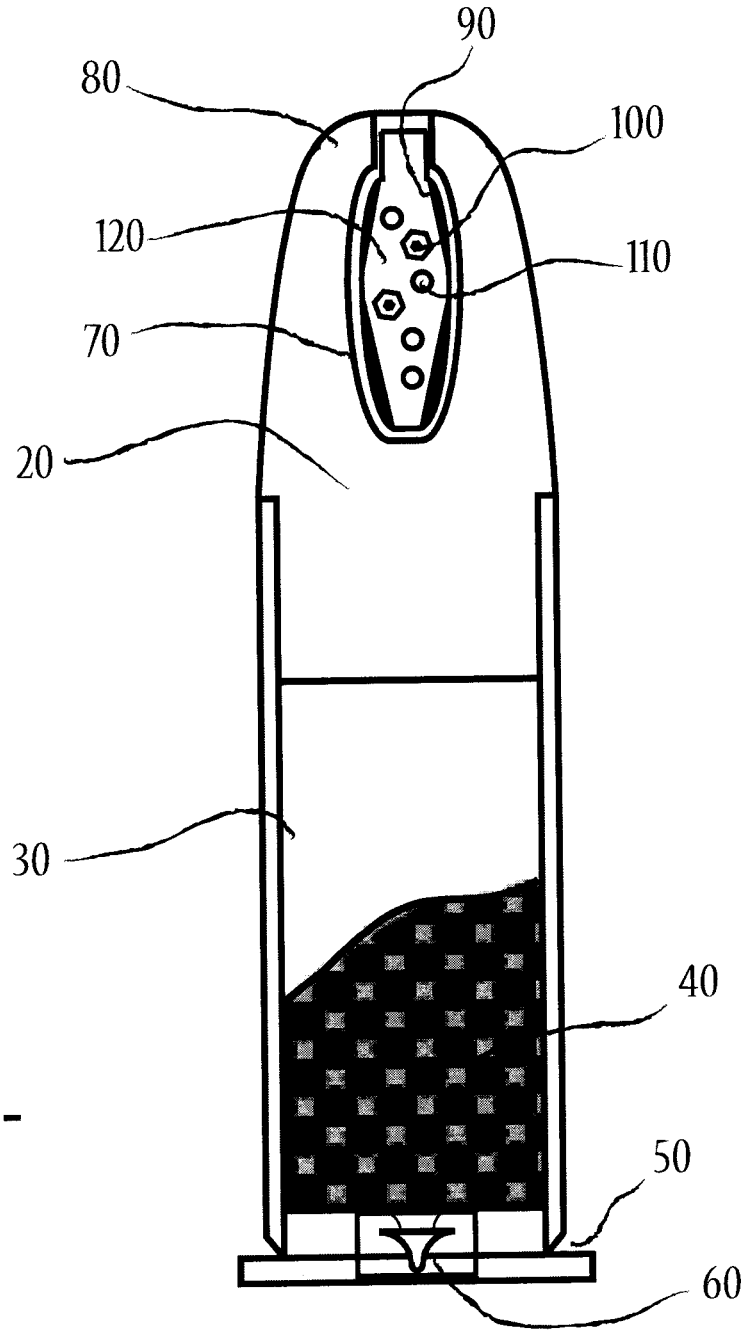
FIG. 1 is a primary embodiment of a new and improved biological active bullet cartridge, shown as a longitudinal cross-section, and revealing main components. There is a cavity near the tip of the bullet that is filled with a cap/plug that is associated with two different biological active substances.

With reference now to the drawings, and in particular to FIG. 1 thereof, the preferred embodiment of the new and improved biologically active projectile bullet embodying the principles and concepts of the present invention and generally designated by the reference numeral 10 will be described.

The present invention, the biological active projectile bullet cartridge 10 is comprised of a plurality of components. Such components in their broadest context include a bullet 20, which serves as the projectile; the case 30, which holds the cartridge components; the propellant 40, which may be gunpowder or cordite; part of the casing used for loading 50; and the primer 60, which ignites the propellant. Such components generally comprise a modern bullet. Further included is a cavity or hollow point region 70 near the tip 80 of the bullet. This cavity or hollow point 70 is filled at least partially by a cap/plug 90. The Cap/plug is associated with at least one active substance that is delivered to a mammalian target, such as a human, which has at least one biological effect on at least tissues, bodily fluids, cells, organ systems, nerve conductance, muscle contraction, or CNS function/consciousness. FIG. 1 is shown with two groups of biological active substances (or pharmaceutically active ingredients), group A particles 100 and group B particles 110. To enhance bleed out of a mammalian target, group A particles may consist of an anticoagulant, such as heparin, and group B particles may consist of a vasodilator, such as isosorbide dinitrate. This example is not meant to be limiting. Group A and B particles could be other active substances, such as nerve agents and neurotoxins to slow and kill a target, blistering agents and nettle agents to cause severe pain, sedatives and muscle relaxers to slow and incapacitate a target, radioisotopes to trace, track, or identify a wounded target, or even infectious biological agents or curative agents. Cap/plug 90 may be non-hollow, or may, itself, contain at least one hollow cavity 120 as shown in FIG. 1 that contains the at least one active substance.

This cap/plug may be comprised of material that is rigid, semi-rigid, non-rigid, resilient, frangible, or non-frangible. This cap/plug may stay intact upon impact or may fragment. This cap/plug may be porous and have active substances embedded in it, or may dissolve when in contact with bodily fluids. In alternative embodiments, this cap/plug may consist of the active substance itself or as a mixture of the active substance with other excipients. In other words, this cap/plug may serve as a vial containing active substances, or serve as a scaffold for holding and delivering active substances, or function like a tablet.

Figure 2:
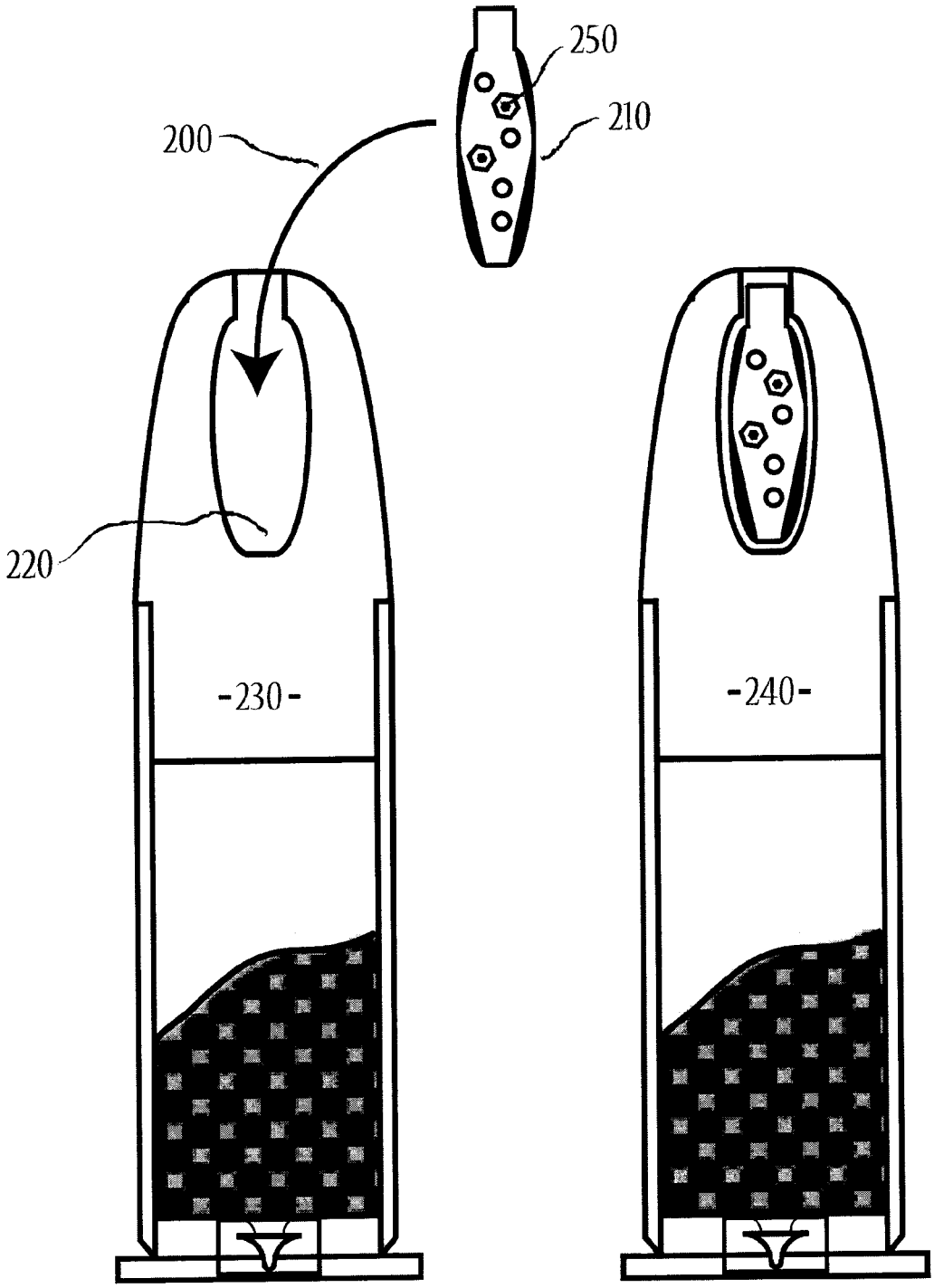
FIG. 2 describes the method of assembling this cap/plug of the primary embodiment into the empty hollow cavity of the bullet. Longitudinal cross-sections are shown.

FIG. 2 describes the method of assembly, as shown by directional arrow 200, of inserting the cap/plug 210 into hollow bullet cavity 220 of bullet 230, prior to loading the assembled cartridge 240 into a firearm and discharging the biological active projectile bullet. Cap/plug 210 is associated with at least one biological active substance 250. Cross-sections are shown.

FIG. 3A shows a bottom-up side view of the biological active projectile bullet 300 that has been discharged from the assembled cartridge 240 of FIG. 2, while FIG. 3B shows a top-down side view of this bullet. FIG. 3C shows the cross-section of this biological active bullet.

Figure 4A:
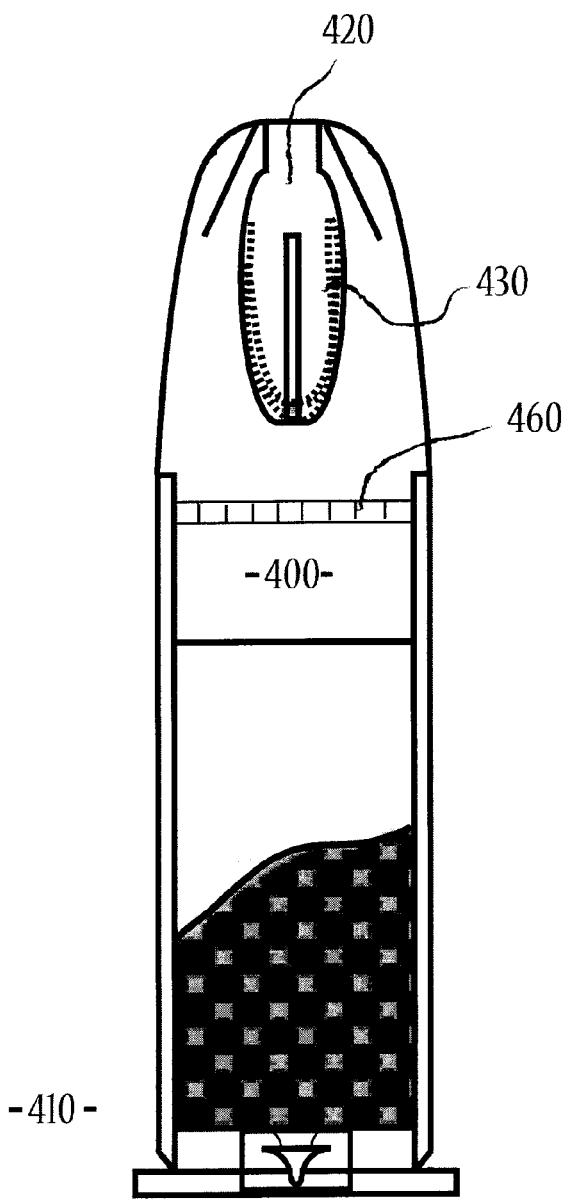
FIG. 4A shows the longitudinal cross-section of an alternative embodiment of a biological active bullet cartridge. This embodiment is a hollow point bullet, and there is no cap/plug that fills the hollow space. Instead, the hollow cavity has been coated with a biological active substance.
Figure 4B:
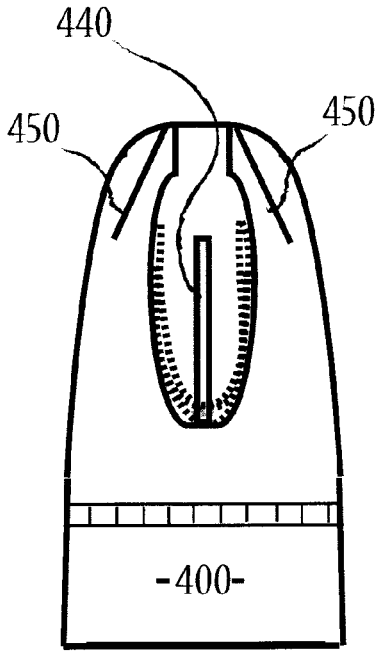
FIG. 4B shows the same longitudinal cross-section of this alternative embodiment bullet after leaving the cartridge.

FIG. 4A shows the cross-section of an alternative embodiment of a biological active projectile bullet 400, as a component of cartridge 410; while FIG. 4B shows this same bullet after being discharged from its case. This alternative embodiment does not have a cap/plug, so that this embodiment resembles a common hollow point bullet. However, this is a biological active projectile bullet as the hollow point cavity 420 has been coated with an active substance 430. This can be accomplished numerous ways, such as by dusting this cavity with an active substance, or by (spray) drying a liquid substance in this cavity, or by adhering powders to this cavity with adhesive excipients. Also shown in this embodiment is a central pin 440 and bullet creases (radially inwardly directed ribs and alternating lines of weakness) 450, which aid in producing a mushrooming effect upon target penetration. A circumferential groove of generally corrugated appearance (circumferentially running cannelure) 460, which has been cut or impressed into a bullet or cartridge case, such as to help hold the bullet in its case, or such as is used when a roll crimp is applied to the bullet. Such a groove may also help remove empty cases of fired ammunition, and may be called an extractor groove.

Figure 5A:
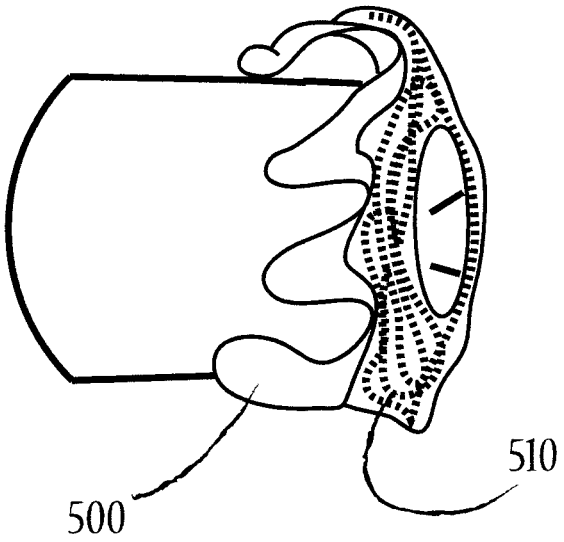
FIG. 5A shows the intended terminal ballistics of the alternative embodiment hollow point bullet, from a side view, after impact and penetration with a target. The bullet has expanded with a mushrooming effect. The hollow point has folded back, thereby, greatly exposing the biological active coating to the body of the target.
Figure 5B:
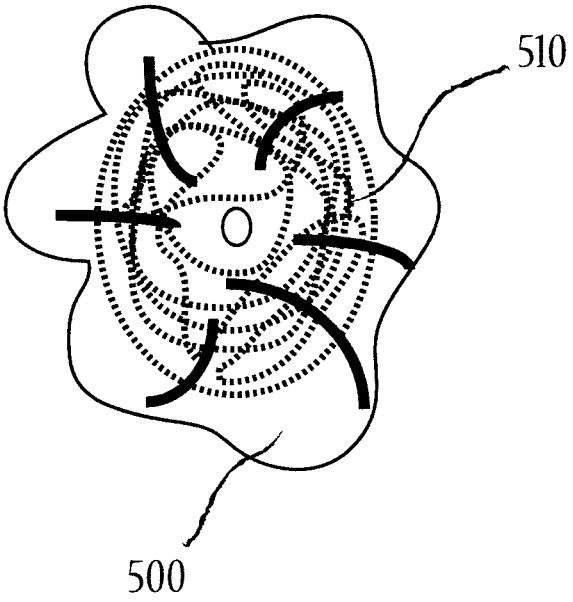
FIG. 5B shows this same alternative embodiment hollow point bullet, from a frontal view, after impact and penetration with a target. The hollow point has folded back, thereby, greatly exposing the biological active coating to the body of the target.

FIG. 5A shows the intended terminal ballistics (after impact and penetration) of what the alternative bullet embodiment of FIG. 4 looks like from a side profile. FIG. 5B shows the mushrooming effect of the terminal ballistics from a frontal tip point of view, similar to that of a common jacketed hollow point bullet. Both FIG. 5A and FIG. 5B demonstrate how the hollow point folded back on itself, thereby, exposing the interior surface 500 of what once formed the hollow point cavity. The active substance(s) 510 coated in the hollow point cavity are now fully exposed to the biological medium after impact.

Figure 6:
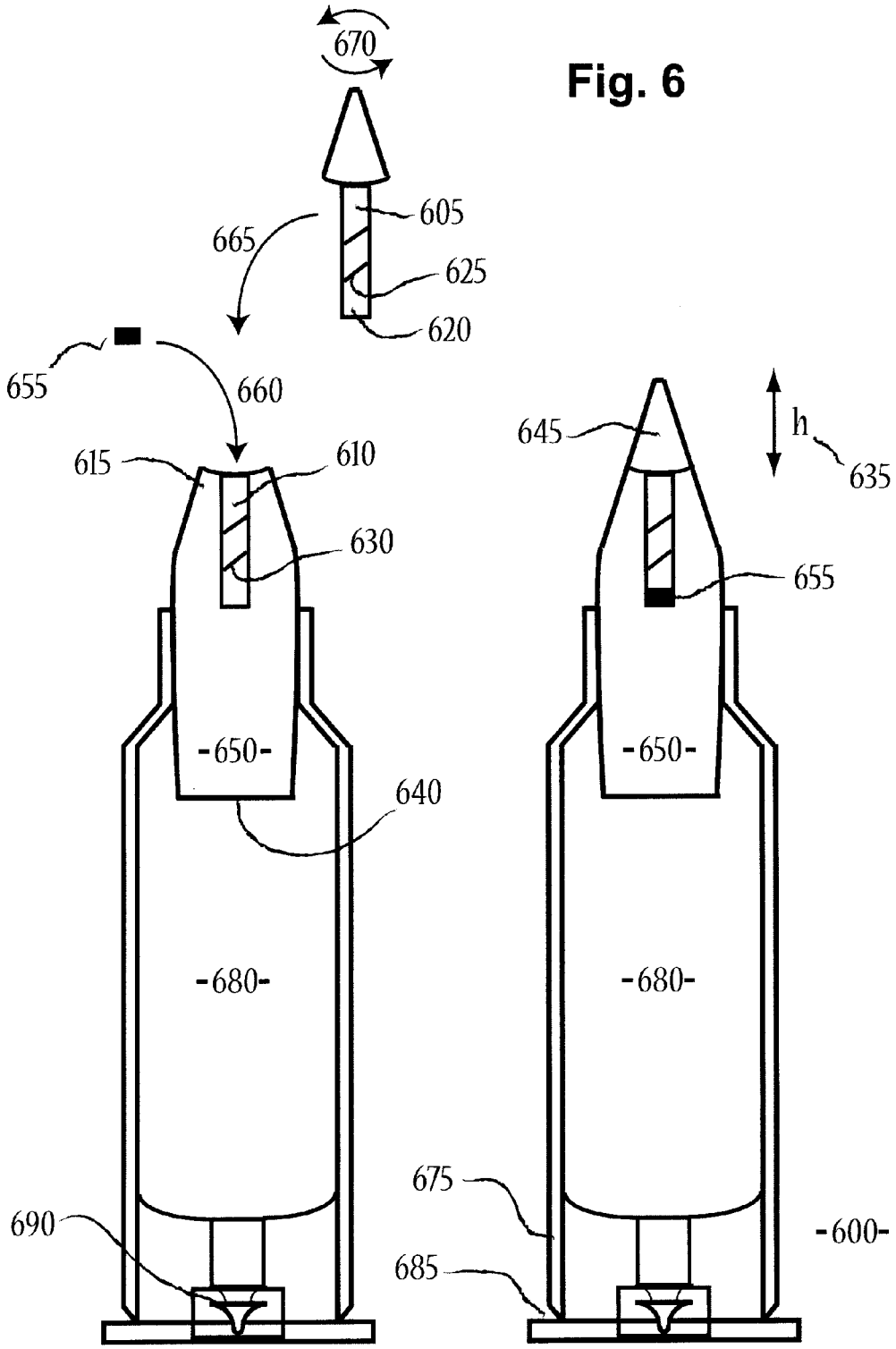
FIG. 6 reveals a second alternative embodiment of a biological active bullet cartridge. The shape of this cartridge makes it desirable for rifle ammunition. This bullet has been bored with a cylindrical cavity having threading. This figure shows a cylindrical solid or pellet comprised of biological active substance, with a similar diameter to the bullet cavity. The Figure shows the method of inserting this active substance into the bullet's cavity. The active substance occupies only a bottom portion of this cavity. Next is described a cap/plug that seals the active substance into this cavity. The cap/plug has a cylindrical section with threads adapted to screw in and fit this cavity in the method shown. The top portion of the cap/plug extends outward with a conical shape, thereby providing this bullet with a pointed tip.

FIG. 6 shows a second alternative embodiment of a biological active projectile bullet cartridge 600. This embodiment shows a cap/plug 605 that screws/secures into a cavity 610 near the tip 615 of the bullet. The base 620 of the cap/plug has at least one securing element 625, such as threads, that mates and secures with a complementary securing element 630, such as threads, along the surface of the bullet cavity 610. The cap/plug 605 may extend a distance 635 from the main bullet housing 640, and may include a pointed tip shape 645. The preferred cap/plug 605 may not occupy the entire bullet cavity 610, such that at least one active substance may occupy at least some of the remaining space of the bullet cavity. This embodiment allows at least one active substance to be placed into this bullet cavity, and then pushed into the cavity and capped by the cap/plug 605. As such, this embodiment allows the one or more active substances to be in a variety of forms, such as a tablet, gel, paste, pellet, etc. Such an embodiment can allow soldiers/officers out in the field to fill bullet 650 of cartridge 600 with active substance, such as tablet/pellet 655, so as to customize the ammunition with the desired active substance, and/or with fresh, less stabile, active substance(s). In this embodiment example, tablet/pellet 655 is cylindrical in shape to match the shape of the bullet cavity, and to fit snugly. The method of filling this bullet with active substance, and then securing the pointed cap/plug to the bullet, is shown by directional arrows 660 (Step A), 665 (Step B), and 670 (Step C).

Also shown is the case 675, which holds the cartridge components; the propellant chamber 680, which may contain gunpowder or cordite; part of the casing used for loading 685; and the primer 690, which ignites the propellant.

Other embodiments have a bullet jacket that can hold a cap/plug securely in place, alternatively, or concurrently. Still, other embodiments may have a circumferential groove of generally corrugated appearance (circumferentially running cannelure) cut or impressed into a bullet or cartridge case, such as to help hold the bullet in its case, or such as is used when a roll crimp is applied to the bullet. A groove may also help remove empty cases of fired ammunition, and may be called an extractor groove. Such optional embodiments are obvious to those skilled in the art, and may not be shown in some figures.

The invention is a projectile structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound.

At least one associated active/potentially active substance is associated with at least one surface of the projectile; chosen from projectile surfaces, including, but not limited to, an exterior surface, such as, the tip surface of the bullet, a side surface of the bullet, the bottom/distal end surface of the bullet, an interior surface, an interior chamber surface, the hollow point cavity surface of a bullet, the surface of a pit/cavity of a bullet, the surface of an interior pit/cavity of a bullet, the surface of an exterior pit/cavity of a bullet, the surface of a cap/plug occupying at least some of a pit/cavity of the bullet, the surface of a cap/plug occupying at least some of a hollow point region of a bullet, the surface between a bullet and jacket, and any combinations thereof; by means selected from projectile associating means, including, but not limited to, dusting, coating, polymerization, mechanical insertion, stuffing, frictional adhesion, chemical bonding, nonchemical bonding, chemical adhesion, chemical adhesion with adhesives, etching, thermo-printing, ink-jet printing, electrostatic interaction, magnetic interaction, drying, spray drying, freeze-drying, injection, and any combinations thereof.

At least one associated active/potentially active substance is associated with at least one spatial region/volume of the projectile, selected from bullet regions/volumes, including, but not limited to, a closed interior chamber of the bullet, closed multiple interior chambers of the bullet, a closed interior chamber of the bullet that becomes exposed within a target upon impact, closed multiple interior chambers of the bullet that become exposed within a target upon impact, a pit/cavity of the bullet, a pit/cavity of the interior of the bullet, a pit/cavity of the exterior surface of the bullet, a hollow point region of the bullet, a hollow point region of the bullet with a relatively narrow opening, a hollow point region of the bullet with a relatively wide opening, a hollow point region of a bullet that is at least partially filled with a cap/tip/plug, and a hollow point region of a bullet that is sealed/closed with a cap/tip/plug, the region between a bullet and jacket, and any combinations thereof; by means selected from projectile associating means, including, but not limited to, dusting, coating, polymerization, mechanical insertion, stuffing, frictional adhesion, chemical bonding, nonchemical bonding, chemical adhesion, chemical adhesion with adhesives, etching, thermo-printing, ink-jet printing, electrostatic interaction, magnetic interaction, drying, spray drying, freeze-drying, injection, and any combinations thereof.

The invention may also be a hollow point bullet projectile with at least one cap/plug occupying at least some of the hollow point region, said at least one cap/plug is selected from cap/plugs, including, but not limited to, a cap/plug capable of retaining/containing at least one active/potentially active substance within this hollow point region, a cap/plug having at least one active substance associated to at least one of its surfaces within this hollow point region, a cap/plug having at least one inner chamber containing at least one active substance, a cap/plug having at least one inner vial containing at least one active substance, a cap/plug embedded with at least one active substance, a cap/plug that is comprised of at least one active substance, cap/plugs that are rigid, cap/plugs that are semi-rigid, cap/plugs that are non-rigid, cap/plugs that are resilient, cap/plugs that are frangible, cap/plugs that are non-frangible, cap/plugs that do not dissolve in bodily fluids, cap/plugs that at least partially dissolve in bodily fluids; said at least one active substance selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound.

The at least one active substance is selected from the forms of active substances, including, but not limited to, solids, liquids, gases, pressurized gases, emulsions, mixtures, gels, pastes, powders, lyophilized powders, films, tapes, beads, pellets, tablets, capsules, coatings, bead coatings, spray dried coatings, freeze-dried coatings, dehydrated substances, and any combinations thereof.

The at least one active substance may at least partially comprise a solid with a shape selected from the class of shapes including, but not limited to, three-dimensional shapes, such as amorphous shapes, porous shapes, spherical shapes, polyhedral shapes, such as cubes, rectangular prisms, pentagonal prisms, hexagonal prisms, other prisms, tetrahedral shapes, and pyramids, disc shapes, conical shapes, cylindrical shapes, saddle-shapes, sheets planes, ruffled/wavy planes, rings and doughnut-like shapes, and any combinations thereof.

The at least one active substance may at least partially comprise a solid with a shape selected from the class of shapes including, but not limited to, three-dimensional shapes, such as amorphous shapes, porous shapes, spherical shapes, polyhedral shapes, such as cubes, rectangular prisms, pentagonal prisms, hexagonal prisms, other prisms, tetrahedral shapes, and pyramids, disc shapes, conical shapes, cylindrical shapes, saddle-shapes, rings and doughnut-like shapes, and any combinations thereof; whereby said shape helps the bullet contain and retain the at least one active substance as the bullet and active substance solid are adapted to fit each other.

The at least one active substance may be associated with at least one excipient.

The at least one active substance may be associated with at least one excipient, an excipient which serves as a stabilizing agent to stabilize the active substance for longer shelf-life.

The at least one active substance may comprise at least part of a rapidly dissolving delivery composition.

The at least one active substance may comprise at least part of a timed/slow-release delivery composition.

The bullet may be capable of delivering at least one femtogram of at least one active substance to the body of the target.

The bullet may be capable of delivering at least one picogram of at least one active substance to the body of the target.

The bullet may be capable of delivering at least one nanogram of at least one active substance to the body of the target.

The bullet may be capable of delivering at least one microgram of at least one active substance to the body of the target.

The bullet may be capable of delivering at least one milligram of at least one active substance to the body of the target.

The bullet may be capable of delivering up to one gram of at least one active substance to the body of the target.

The bullet may be capable of delivering more than one gram of at least one active substance to the body of the target.

At least one active substance may be associated with at least one excipient that enhances the delivery of the active ingredient within the body of the target.

At least one substance having potential activity may be associated with at least one excipient that activates the at least one substance upon/after impact.

At least two active/potentially active substances may interact with each other upon/after impact.

At least two active/potentially active substances may synergistically interact with each other upon/after impact.

At least two active/potentially active substances may interact with each other to activate at least one of these substances upon/after impact.

At least one potentially active substance may become active upon impact and penetration selected from bodily interacting means, including, but not limited to, interaction with bodily materials; such as bodily fluids, bodily enzymes, and bodily materials with redox potential; the temperature inside the body, the pH inside the body, and any combinations thereof.

At least one active substance may be selected from catalysts, including, but not limited to, non-organic catalysts, organic catalysts, naturally occurring enzymes, laboratory created enzymes, proenzymes requiring processing for activation, such as proteolytic processing, and any combinations, thereof.

At least one substance may be a catalyst, such as an enzyme, and is associated with at least one other substance, that serves as a cofactor/coenzyme.

At least one potentially active substance may be a catalyst, such as a proenzyme, and is associated with at least one other catalyst/enzyme that processes this potentially active proenzyme, by processing means, including, but not limited to, proteolytic processing, so as to activate the potentially active proenzyme into a functional enzyme.

At least one active/potentially active substance may be an enzyme, selected from the class of enzymes, including, but not limited to, oxidoreductases, transferases, lyases, kinases, isomerases, ligases, and hydrolases, such as, proteases, lipases, phospholipases, nucleases, carbohydrases, digestive enzymes, and any combinations thereof, that acts on/within the body of the target.

At least one active/potentially active substance may be an inhibitor selected from the class of chemical reaction inhibitors, including, but not limited to, catalytic inhibitors and enzyme inhibitors, and any combinations thereof, that acts on/within the body of the target.

At least one active substance may be selected from vasodilators, including, but not limited to, hydralazine, isosorbide mononitrate, isosorbide dinitrate, sildenafil, tadalafil, and any combinations thereof, so as to cause enhanced wound bleeding in the body of the target.

At least one active substance may be selected from anticoagulants, including, but not limited to, heparin, coumadin, warfarin, lovenox, and fragmin, and any combinations thereof, so as to cause enhanced wound bleeding in the body of the target.

At least one active substance may be selected from radioactive materials, including, but not limited to, radionuclides, including radioactive primordial nuclides, naturally occurring non-primordial nuclides, synthetic nuclides, gamma ray emitting isotopes, beta particle only emitting isotopes, alpha particle only emitting isotopes, and other radioisotopes, such as multiple radiation emitting isotopes, such as to detect/track and at least damage, the body of the target.

At least one active substance may be selected from dyes, including, but not limited to, stains, biological stains, histological stains, tissue-interacting dyes, such as those that interact with blood, fluorescent dyes, infrared dyes, and immunolabeling markers and biomarkers, and any combinations thereof, such as to identify/track the target.

At least one active substance may be selected from nerve agents, including, but not limited to, organophosphates, such as G-agents, including tabun (GA), sarin (GB), soman (GD), cyclosarin (GF), and GV, V-agents, including EA-3148, VE, VG, VM, VR, and VX, Novichok agents, and any combinations thereof.

At least one active substance may be selected from neurotoxins, including, but not limited to, ion channel inhibitors, such as sodium channel inhibitors, such as tetrodotoxin, potassium channel inhibitors, chloride channel inhibitors, such as curare, calcium channel inhibitors, such as conotoxin, inhibitors of synaptic vesicle release, such as botulinum toxin, and receptor inhibitors, such as bungarotoxin and 3-quinuclidinyl benzilate (QNB), and any combinations thereof, so as to interrupt at least some of a biological target's function.

At least one active substance may be selected from blistering agents (vesicants), including, but not limited to, ethyldichloroarsine (ED), methyldichloroarsine (MD), phenyldichloroarsine (PD), lewisite (L), sulfur- and nitrogen-based mustards (mustard gas), and any combinations thereof.

At least one active substance may be selected from irritants, including, but not limited to, necrotic agents, nettle agents/urticants, such as phosgene oxime (CX), corrosive materials, such as acids and bases, and pain-inducing agents and other irritants, such as capsaicin and dibenzoxazepine (CR), and any combinations thereof.

At least one active substance may be selected from muscle relaxants/paralytics, including peripherally acting muscle relaxants, such as atracurium and tubocurarine, centrally acting muscle relaxants, including carisoprodol and benzazepam, and directly acting muscle relaxants, such as dantrolene, and any combinations thereof, so as to interrupt at least some muscle movement in a biological target.

At least one active substance may be selected from sedatives, including, but not limited to, opioid receptor agonists, such as etorphine (M99), GABA receptor agonists, such as allobarbital, histamine receptor inverse agonists, such as diphenhydramine, alpha-1 adrenergic receptor antagonists, such as detomidine, alpha-2 adrenergic receptor agonists, such as xylazine, dopamine receptor antagonists, such as haloperidol, serotonin receptor antagonists, such as trazodone, neurotransmitter reuptake inhibitors, such as sertraline, melatonin receptor agonists, such as melatonin, orexin/hypocretin receptor antagonists, and any combinations thereof, to cause at least some sedation in a biological target.

At least one active substance may be selected from spasmodic agents, such as, but not limited to, cholinergic agents, such as to at least cause some muscle spasm, said at least some muscle spasm having effects on a biological target selected from spasmodic effects, including, but not limited to, skeletal muscle spasms, heart muscle spasms, arterial spasms, diaphragm muscle spasms, spasms of other muscles involved with respiration, and any combinations thereof.

At least one active substance may be selected from hallucinogens/hallucinogenic agents, such as, but not limited to, psychedelics, dissociatives, and deliriants, such as to at least disorient a biological target.

At least one active substance may be selected from centrally acting agents, such as, to affect the central nervous system of the target.

At least one active substance may be selected from convulsive agents, such as, but not limited to, cyanide, such as to at least cause some convulsive and seizure-like activity in a biological target.

At least one active substance may be selected from toxic agents, including, but not limited to, poisons, necrotic toxins, carcinogenic agents, mutagenic agents, highly toxic agents, and highly toxic agents with a median lethal dose below one milligram per kilogram of body weight, such as ricin and abrin, and any combinations thereof.

At least one active substance may be selected from infectious agents, including, but not limited to, bacteria, gram positive bacteria, gram negative bacteria, bacterial spores, such as anthrax, bacteria with virulent genes artificially added, such as with added plasmids, yeast, yeast with virulent genes artificially added, archaebacteria, viruses, viruses with virulent genes artificially added, naturally occurring strains of infectious agents, laboratory created strains of infectious agents, prions, artificial gene vectors, liposomal vectors, microbes (microorganisms), parasites, microscopic worms, insects, larvae, the eggs of parasitic organisms, dried infectious agents, dried pathogens, dried parasites, freeze dried infectious agents, freeze dried pathogens, freeze dried parasites, and any combinations thereof, so as to inoculate a biological target with at least one infectious agent.

At least one active substance may be selected from curative agents, including, but not limited to, antidotes, antivenoms, antispasmodics, such as anticholinergics, anti-seizure agents (anticonvulsives), antimicrobial agents, antibacterial agents, antiviral agents, artificial gene vectors, liposomal vectors, nucleic acids, such as siRNA, antibodies, immunoglobulin fragments, medicines, other therapeutic agents, and any combinations thereof, for acting on an infected/affected biological target, acting means selected from at least one of treating a biological target and neutralizing a potential epidemic threat.

At least one active substance may be selected from biological signaling molecules, including, but not limited to, primary messenger molecules, secondary messenger molecules, cell signaling molecules, guanine nucleotide-binding proteins, G proteins, cellular receptor signaling molecules, kinases, metabolic signaling molecules, such as cyclic adenosine monophosphate, immune system signaling molecules, such as cytokines, steroids, and peptide hormones.

At least one active/potentially active substance is delivered to a human/mammalian target after the projectile is discharged from a firearm, said at least one active substance is selected from the class of chemical, pharmaceutical, and biological materials, including, but not limited to: unformulated active pharmaceutical ingredient, formulated active pharmaceutical ingredient, non-biological materials, biological materials, plant material or extracts, animal material or extracts, cellular material or extracts, cultured cell line material or extracts, cells, stem cells, bacterial material or extracts, fungal material or extracts, viral material or extracts, peptides, polypeptides, recombinant proteins, glycoproteins, sugars, such as monosaccharides, disaccharides, and polysaccharides, oils, lipids, such as fatty acids and prostaglandins, cholesterol, lipoproteins, vesicles, liposomes, nutrients/supplements, holistic substances, antibodies/immunoglobulins and fragments thereof, water, water soluble substances, water insoluble substances, vitamins, coenzymes, enzymes, substrates, inhibitors, hormones, steroids, amino acids, neurotransmitters, cell signaling molecules, antibiotics, cellular receptors and/or receptor fragments, ion channels/ion channel fragments, ligands/ligand fragments, single stranded/double stranded nucleotides such as deoxyribonucleic acids, ribonucleic acids, small interfering RNA, siRNA, transcription factors, transcription inhibitors, translation factors, translation inhibitors, vaccines, antihistamines, anti-inflammatory substances, cytotoxic substances, anti-toxins, anti-venoms, anticoagulants, vasodilators, bronchodilators, stimulants, anti-depressants, analgesics, anesthetics, therapeutic gases, including, but not limited to nitric oxide, nitrous oxide, hydrogen sulfide, carbon monoxide, carbon dioxide, nitrogen, cyclopropane, helium, and oxygen, diatomic molecules and gases, electrolytes, ionic substances, non-ionic substances, hydrocarbons, minerals, salts, hydrates, anhydrates, naturally occurring non-organic molecules and compounds, synthetic/modified non-organic molecules and compounds, naturally occurring organic molecules and compounds, synthetic/modified organic molecules and compounds, medical/diagnostic probes/tracers, fluorescent substances, magnetic substances, radioisotopes and radioactive substances, nanoparticles, from any phase of any of these aforementioned materials, such as solid, liquid, and gaseous phases, polymers of any of these aforementioned materials, precursors of any of these aforementioned materials, derivatives of any of these aforementioned materials, enantiomers of any of these aforementioned materials, stereoisomers of any of these aforementioned materials, hybrid molecules of any of these aforementioned materials, combinations of any of these aforementioned materials, suspensions, mixtures/solutions/combinations of any of these aforementioned materials.

The projectile is comprised of at least one material selected from the group of hard materials, including, but not limited to, aluminum, antimony, beryllium, bismuth, boron carbide, brass, bronze, chromium, cobalt, copper, gold, iridium, iron, lead, magnesium, mercury, molybdenum, nickel, palladium, platinum, rhodium, silicon carbide, silver, steel, hardened steel, tantalum, tellurium, tin, titanium, tungsten, tungsten carbide, carbon fiber, depleted uranium, zinc, zirconium, metalloids, metal alloys, and any combinations thereof.

The projectile may further include at least one integrated circuit, selected from the class of electronic circuit containing elements, including, but not limited to, microchips, nanobots, data transmitters, sensors, radio-frequency identification (RFID) tags, implants, bioelectronic devices, or any combination thereof, such as to deliver this circuit to the target and track/manipulate the biological target.

The projectile may further include at least one energy source, selected from the class of power sources, including, but not limited to, fuels, fuel cells, batteries, electrolytes, biological powered batteries, and energy derived of kinetic energy from motion.

At least one active substance may be contained in a vial inside the bullet, selected from vials, including, but not limited to, glass vials, plastic vials, and metallic vials.

The projectile may be capable of making a normally non-fatal gunshot wound fatal.

The projectile is able to maintain adequate ballistics, such as, but not limited to, aerodynamic efficiency, synchronized spin, trajectory, and range.

At least one active substance may be selected from allergens/allergenic agents, such as, but not limited to, allergens that cause anaphylaxis, allergens that cause anaphylactic-shock, antigens, and immunogens, and any combinations thereof.

The projectile may also be further weatherproofed/waterproofed to protect the at least one active substance, such as before the projectile reaches its target.

The invention may also be a hollow point bullet projectile with at least one active substance occupying at least some portion of the hollow point cavity; said at least one active substance selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound.

The invention may also be a projectile structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one non-liquid active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound.

The invention may also be a bullet projectile structured to be discharged from a firearm, said bullet comprising no more than two bullet body portions, said bullet further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound.

The invention may also be a bullet projectile structured to be discharged from a firearm, said bullet not comprising a plurality of subprojectiles, said bullet further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound.

The invention may also be a bullet projectile structured to be discharged from a firearm, said bullet comprising no more than two bullet body portions, and said bullet not comprising a plurality of subprojectiles, said bullet further associated with at least one non-liquid active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound.

The invention may also be a biological active bullet ammunition system that is able to deliver a combination of different biologically active substances to a target to cause a combination of biological effects.

The invention may also be a bullet structured to be propelled from a bullet propelling device, including, but not limited to, hand guns, revolvers, semi-automatic weapons, automatic weapons, rifles, air guns, and rail guns, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human.

The invention may also be a cartridge containing a bullet structured to be propelled from a bullet propelling device, including, but not limited to, hand guns, revolvers, semi-automatic weapons, automatic weapons, rifles, air guns, and rail guns, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human.

The invention may also be a cartridge containing at least a propellant and a bullet structured to be propelled from a bullet propelling device, including, but not limited to, hand guns, revolvers, semi-automatic weapons, automatic weapons, rifles, air guns, and rail guns, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human.

The invention may also be a cartridge containing at least a propellant, a primer, a case/shell, and a bullet structured to be propelled from a bullet propelling device, including, but not limited to, hand guns, revolvers, semi-automatic weapons, automatic weapons, rifles, air guns, and rail guns, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human.

The invention may also be an interchangeable cap/plug and biologic active bullet system, so that a cap/plug associated with at least one biologic active substance can be interchanged with a cap/plug associated with a different biologic active substance, so as to vary/customize the desired biologic effects using the same cartridge platform.

The invention may also be a non-interchangeable cap/plug and biologic active bullet system, so that a cap/plug associated with at least one biologic active substance cannot be interchanged with a cap/plug associated with a different biologic active substance, said bullet and bullet cavity are adapted to fit only a specific cap/plug associated with a certain biologic active substance, so as to prevent confusion and tampering of the bullet system.

The invention may also be a magazine containing at least one projectile cartridge structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound.

The invention may also be a biological active bullet ammunition system that is able to deliver at least one substance of a wide range of different biologically active substances to a target to cause a biological effect.

The invention may also be a firearm, such as but not limited to a gun, containing at least one projectile cartridge structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound.

The invention may also be a firearm, such as but not limited to a gun, having at least one magazine that contains at least one projectile cartridge structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound.

The invention may also be a firearm, such as but not limited to a gun, specifically adapted to load and discharge at least one specifically adapted projectile cartridge structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound, such that this ammunition is not compatible with other types of guns.

The invention may also be a method of applying an active substance, chosen from methods including, but not limited to, painting, coating, injecting, freeze-drying, and spray drying an active substance, within a cavity of a bullet, chosen from bullet cavities, such as, but not limited to, a hollow point cavity.

The invention may also be a method of applying an active substance, chosen from methods including, but not limited to, painting, coating, injecting, freeze-drying, and spray drying an active substance, within a cavity of a bullet, such as, but not limited to, deep within a cavity of a bullet, chosen from bullet cavities, such as, but not limited to, a hollow point cavity, such as to ensure that the active substance cannot be touched by the firearm user, such as by not coming into contact with the with hands or fingers, when handling the bullet cartridge.

The invention may also be a method of loading into a firearm, such as but not limited to a gun, at least one projectile cartridge structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound.

The invention may also be a method of loading into a magazine at least one projectile cartridge structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound.

The invention may also be a method of loading a firearm, such as but not limited to a gun, with at least one magazine that contains at least one projectile cartridge structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound.

The invention may also be a method of discharging/firing from a firearm, such as but not limited to a gun, at least one projectile bullet from cartridge structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound.

The invention may also be a method of manufacturing a bullet projectile structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound.

The invention may also be a method of adding active substance to a bullet projectile structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound.

The invention may also be a method of adding active substance to a bullet projectile structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound, the adding being done in a factory.

The invention may also be a method of adding active substance to a bullet projectile structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound, the adding being done by a user/soldier out in the field.

The invention may also be a method of switching active substances in a bullet projectile structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound, the switching being done by a user/soldier out in the field.

The invention may also be a method of manufacturing a bullet projectile structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound, the manufacturing being done in a cartridge.

The invention may also be a method of storing a bullet projectile structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound, the storing being done in a cartridge.

The invention may also be a method of labeling and identifying a bullet/ammunition structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound, the labeling selected from identification means, including, but not limited to, painted indicia, metal etched indicia, painted barcodes, metal etched bar codes, RFID circuitry, dating means, and any combinations thereof.

The invention may also be a method of tracking a bullet projectile structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one active/potentially active substance, selected from the class of active substances, including, but not limited to, chemically active substances, biologically active substances, radioactive substances, thermodynamically active substances, and pharmaceutically active ingredient substances, and any combinations of active substances thereof; and capable of delivering this at least one active substance to/within a target, including, but not limited to, a mammal, such as a human, and having at least one effect/biological effect on the target, in addition to the bullet wound, the tracking being after entry into a mammalian target.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A method of applying at least one biologically active/potentially biologically active substance to a lethal metal bullet projectile with at least one excipient ingredient; said lethal metal bullet projectile structured to be packaged in a cartridge/shell and configured to be discharged from a gun/firearm and used as a weapon; said at least one biologically active/potentially biologically active substance causing at least one harmful effect/biological effect including tissue damage in a human target immediately after impact and penetration of said lethal metal bullet projectile into said human target; said at least one harmful effect/biological effect including tissue damage in addition to a tissue wound caused by said impact/penetration of said lethal metal bullet projectile to ensure enhanced damage and lethality of said bullet projectile, and capable of making a normally non-fatal gunshot wound fatal;

said at least one biologically active/potentially biologically active substance is chosen from non-organic catalysts and serves as a necrotic agent when becoming chemically, biologically, and thermodynamically active and cytotoxic from interaction with bodily materials, including bodily fluids, upon lethal metal bullet projectile impact and penetration, undergoing chemical reactions in said human target, including with bodily fluids, and resulting in at least one of electrolyte and gas delivered to tissue within said human target;

said at least one excipient ingredient serves as a stabilizing agent to stabilize said at least one biologically active/potentially biologically active substance at least before delivery to/within said human target, preventing said at least one biologically active/potentially biologically active substance from reacting until exposed in bodily fluids, and therefore, enhancing delivery of said at least one active/potentially active substance to tissue within said human target.

2. A method of applying at least one biologically active/potentially biologically active substance to a non-plastic lethal bullet body as at least one plug/bullet body portion that at least partially dissolves in bodily fluids; said non-plastic lethal bullet body structured to be packaged in a cartridge/shell and configured to be discharged from a gun/firearm and used as a weapon; said at least one biologically active/potentially biologically active substance having at least one effect/biological effect including tissue damage inside a human target after impact and penetration into said human target; said at least one effect/biological effect including tissue damage in addition to tissue damage caused by impact/penetration of said non-plastic lethal bullet body, and capable of making a non-fatal gunshot wound fatal; said at least one biologically active/potentially biologically active substance is chosen from non-organic catalysts and serves as a necrotic agent when becoming chemically, biologically, and thermodynamically active and cytotoxic from interaction with bodily materials, including bodily fluids, undergoing chemical reactions in said human target, including with bodily fluids, and resulting in at least one of electrolyte and gas delivered to tissue within said human target.

* * * * *